United States Patent [19]

Deutschle

[11] Patent Number: 4,475,312

[45] Date of Patent: Oct. 9, 1984

[54] DOOR ASSEMBLY

[75] Inventor: Bruno J. Deutschle, Romasnshorn, Switzerland

[73] Assignee: F. L. Saino Manufacturing Co., Memphis, Tenn.

[21] Appl. No.: 535,208

[22] Filed: Sep. 23, 1983

[51] Int. Cl.[3] ..... E05F 11/00

[52] U.S. Cl. ..... 49/360; 49/409

[58] Field of Search ..... 49/360, 362, 199, 200, 49/409–412; 160/188; 474/147, 146

[56] References Cited

U.S. PATENT DOCUMENTS

| | | | |
|---|---|---|---|
| 1,532,171 | 4/1925 | Burmeister | 49/360 L X |
| 3,608,612 | 9/1971 | Pemberton et al. | 49/360 X |
| 3,802,125 | 4/1974 | Baker | 49/360 |
| 4,231,191 | 11/1980 | Ellmore | 49/360 X |
| 4,296,570 | 10/1981 | Balbach et al. | 49/360 |

*Primary Examiner*—Philip C. Kannan

*Attorney, Agent, or Firm*—Walker & McKenzie

[57] ABSTRACT

A guide structure for a door assembly of the type including a door member, an endless chain member coupled to the door, and a drive mechanism for drawing the chain member to cause the door member to move between opened and closed positions. The guide structure includes an elongated metal body for receiving the span portions of the chain member, and plastic guide members positioned within the body for guidingly engaging the chain member to assure a smooth, quiet operation of the door assembly with no metal-to-metal contact.

8 Claims, 6 Drawing Figures

DOOR ASSEMBLY

BACKGROUND OF THE INVENTION

1. Field of the Invention

The present invention relates to door assemblies of the type including a door member for selectively covering an opening in a wall, an endless chain member, a coupling means for coupling the chain member to the door member, and a drive means for driving the chain member to cause the door member to move between an opened and a closed position.

2. Description of the Prior Art

Various door assemblies of the above described type have heretofore been developed. See, for example, Graves, U.S. Pat. No. 1,506,925. While the door assembly disclosed in the Graves patent has a manual, crank-type drive means, it is well-known to those skilled in the art to utilize electric motors and appropriate control means to drive the endless chain members. Such prior art door assemblies do not disclose or suggest the present invention.

SUMMARY OF THE INVENTION

The present invention is directed toward improving prior door assemblies of the above described type. The concept of the present invention is to provide such a door assembly with a guide means for guidingly constraining the chain member to provide a safer, longer lasting, and quieter door assembly.

The guide means of the present invention includes an elongated body means for receiving the first and second span portions of an endless chain member, the body means having an elongated first channel for receiving the first span portion and having an elongated second channel for receiving the second span portion; an elongated first guide means for guiding the first span portion within the first channel, the first guide means including an elongated first guide member positioned within the first channel for guidingly engaging a first side of the first span portion, the first guide means including an elongated second guide member positioned within the first channel for guidingly engaging a second side of the first span portion; and an elongated second guide means for guiding the second span portion of the chain member, the second guide means including an elongated first guide member positioned within the second channel for guidingly engaging a first side of the second span portion, the second guide means including an elongated second guide member positioned within the second channel for guidingly engaging a second side of the second span portion.

DESCRIPTION OF THE PREFERRED EMBODIMENT

Figure 1:
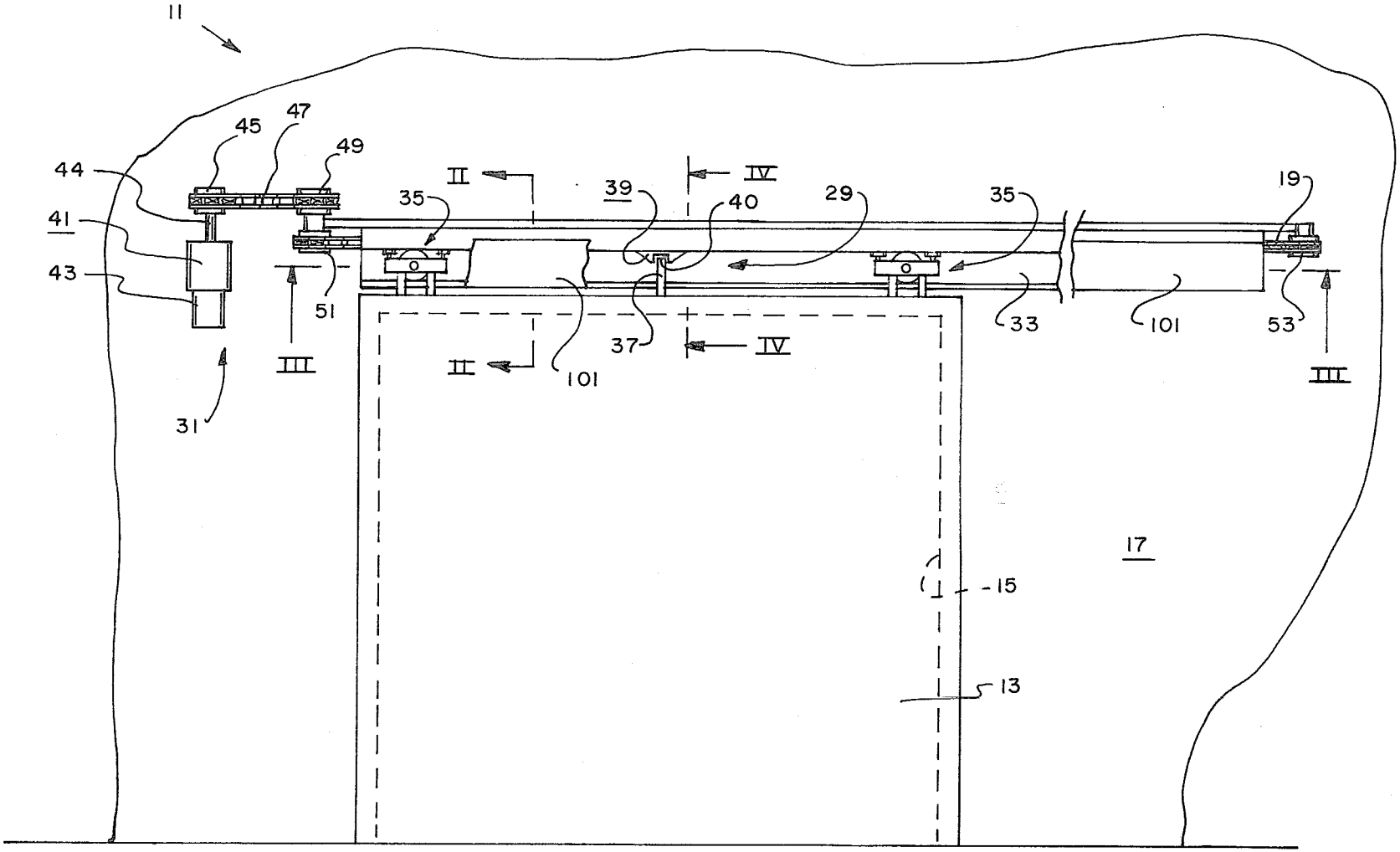
FIG. 1 is a somewhat diagrammatic front elevational view of the door assembly of the present invention.

The door assembly 11 of the present invention is of the type that includes a door member 13 for selectively covering an opening 15 in a wall 17; an endless chain member 19 having first and second span portions 21, 23 joined by first and second bight portions 25, 27; coupling means 29 for coupling the chain member 19 to the door member 13; and drive means 31 for driving the chain member 19 to cause the door member 13 to move between an opened and a closed position (see, in general, FIG. 1). Such a door assembly 11 may be constructed in various manners now apparent to those skilled in the art. Preferably, the door member 13 is slidably mounted with respect to the opening 15 and the wall 17. Thus, for example, the door member 13 may be rollably supported from a horizontally extending track 33 by way of typical support rollers 35 and the like. The track 33 is preferably fixedly attached to the wall 17 in a location above the opening 15.

The coupling means 29 may consist of an upwardly extending finger 37 attached to the door member 13 in any manner apparent to those skilled in the art, and an entrappment member 39 having a notch 40 or the like for entrapping the upper end of the finger 37 (see, in general, FIGS. 1 and 5) whereby back and forth movement of the entrappment member 39 will cause the finger 37 and therefore, the door member 13 to move back and forth. The entrappment member 39 is constructed in such a manner to allow it to be coupled to the chain member 19 in a typical manner whereby movement of the chain member 19 will cause corresponding movement of the entrappment member 39.

Figure 3:
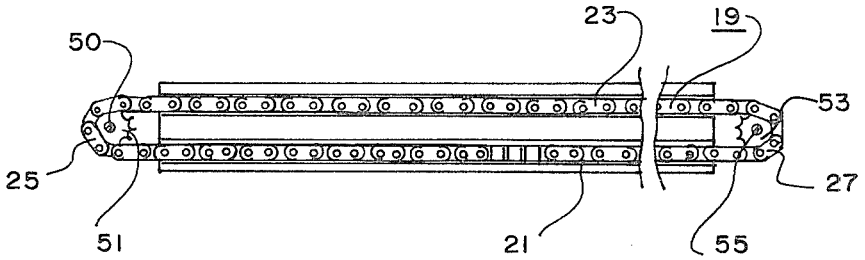
FIG. 3 is a somewhat diagrammatic sectional view substantially as taken on line III—III of FIG. 1 with portions thereof broken away for clarity.
Figure 4:
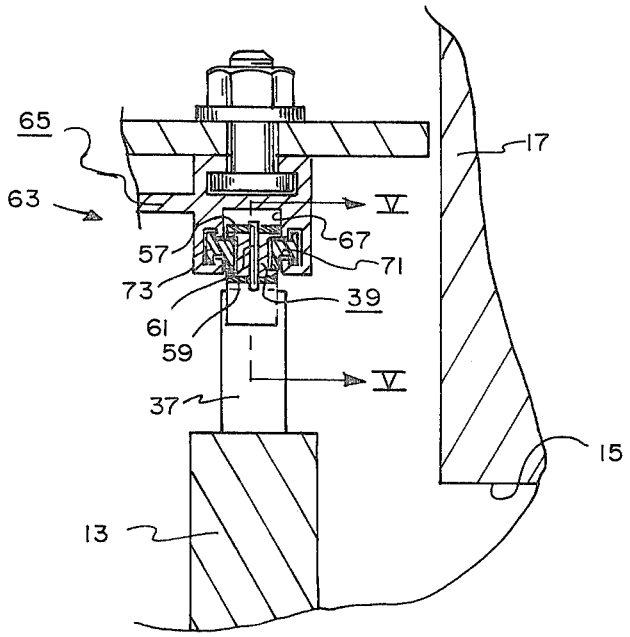
FIG. 4 is an enlarged sectional view substantially as taken on line IV—IV of FIG. 1.

The drive means 31 may consist of a typical electric motor 41 controlled in various manners such as by way of a control module 43 or the like and coupled to the chain member 19 in a manner (see, in general, FIGS. 1 and 3) so as to cause movement of the chain member 19 in a back and forth direction. Preferably, the electric motor 41 includes a drive shaft 44 coupled to a typical drive sprocket 45 for rotatably driving a drive chain 47. The drive chain 47 is in turn drivably coupled to a first driven sprocket 49 which is drivably coupled by way of a shaft member 50 or the like to a second driven sprocket 51. The first bight portion 25 of the chain member 19 extends about the second driven sprocket 51. The second bight portion 27 of the chain member 19 extends about an idler sprocket 53 mounted on a shaft member 55. Thus, back and forth rotation of the drive shaft 44 of the electric motor 41 will cause the first and second span portions 21, 23 of the chain member 19 to move back and forth.

Figure 5:
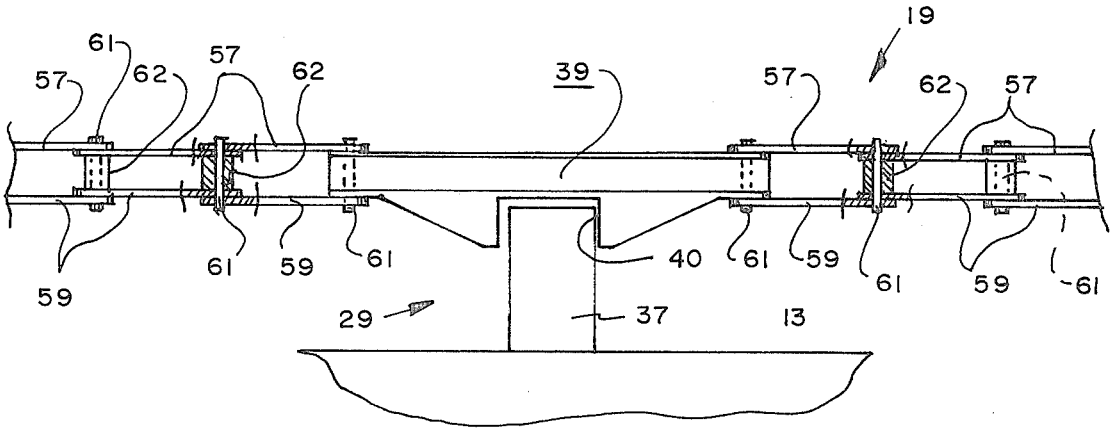
FIG. 5 is a somewhat diagrammatic sectional view substantially as taken on line V—V of FIG. 4 with portions thereof broken away for clarity.
Figure 6:
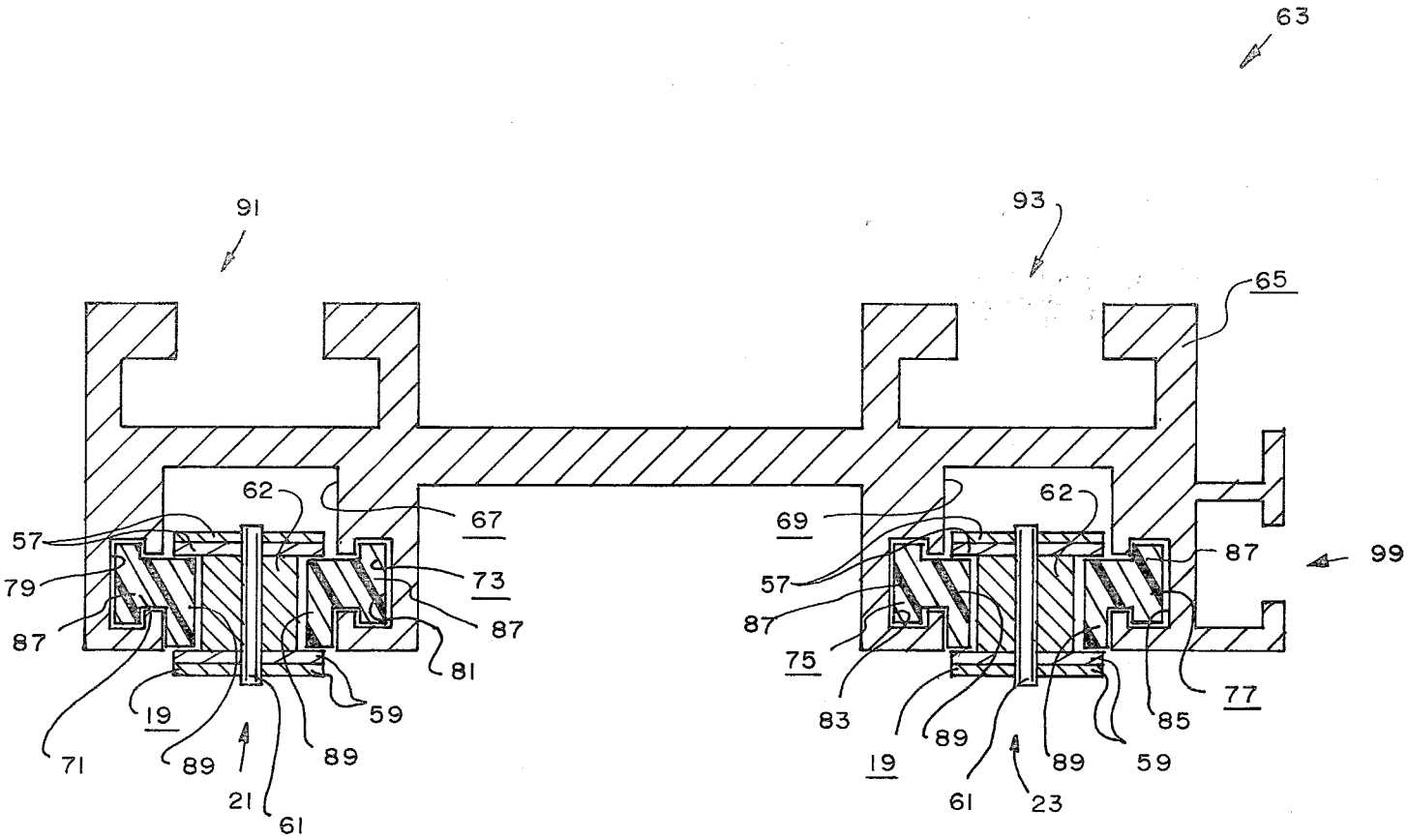
FIG. 6 is an enlarged sectional view of a portion of the door assembly of the present invention.

The chain member 19 is constructed in any typical manner and preferably includes a plurality of spaced apart upper and lower plate members 57, 59 joined by a plurality of pin members 61 and bushing members 62 (see, in general, FIGS. 5 and 6). The entrappment member 39 is attached at one end to one set of upper and lower plate members 57, 59 by a pin member 61 and at the other end to another set of upper and lower plate members 57, 59 by a pin member 61 as clearly shown in FIG. 5 whereby the entrappment member 39 becomes, in effect, an integral component of the chain member 19 whereby back and forth movement of the first and second span portions 21, 23 of the chain member 19 as a result of back and forth rotation of the drive shaft 44 of the electric motor 41 will cause the door member 13 to move between opened and closed positions. The distance the door member 19 moves will, of course, be determined by the amount of rotation of the drive shaft 44 of the electric motor 41. Such rotation can be controlled in various manners well-known to those skilled in the art such as by way of the typical control module 43.

The present invention includes the combination with such structure of a guide means 63 for guidingly constraining the chain member 19. The guide means 63 includes an elongated body means 65 for receiving the first and second span portions 21, 23 of the chain member 19 (see, in general, FIG. 6). The body means 65 has an elongated first channel 67 for receiving the first span portion 21 of the chain member 19 and has an elongated second channel 69 for receiving the second span portion 23 of the chain member 19.

The guide means 63 includes an elongated first guide means for guiding the first span portion 21 of the chain member 19 within the first channel 67 of the body means 65, the first guide means including an elongated first guide member 71 positioned within the first channel 67 for guidingly engaging a first side of the first span portion 21 and includes an elongated second guide member 73 positioned within the first channel 67 for guidingly engaging a second side of the first span portion 21.

The guide means 63 also includes a second guide means for guiding the second span portion 23 within the second channel 69. The second guide means includes an elongated first guide member 75 positioned within the second channel 69 for guidingly engaging a first side of the second span portion 23 and includes an elongated second guide member 77 positioned within the second channel 69 for guidingly engaging a second side of the second span portion 23.

The first and second guide means act to prevent any direct contact between the chain member 19 and the body means 65.

The first channel 67 of the body means 65 preferably has a first undercut kerf 79 for fixedly receiving the first guide member 71 and preferably has a second undercut kerf 81 for fixedly receiving the second guide member 73. Likewise, the second channel 69 of the body means 65 preferably has a first undercut kerf 83 for fixedly receiving the first guide member 75 and preferably has a second undercut kerf 85 for fixedly receiving the second guide member 77. Preferably, each of the guide members 71, 73, 75, 77 of the first and second guide means has an attachment flange portion 87 for tightly fitting into the undercut kerf 79, 81, 83, 85 of the respective one of the channels 67, 69 of the body means 65. Additionally, each guide member 71, 73, 75, 77 of the first and second guide means has a guide flange portion 89 for extending between the upper and lower plate members 57, 59 and the bushing member 62 of the chain member 19 to thereby guidingly constrain the chain member 19.

Figure 2:
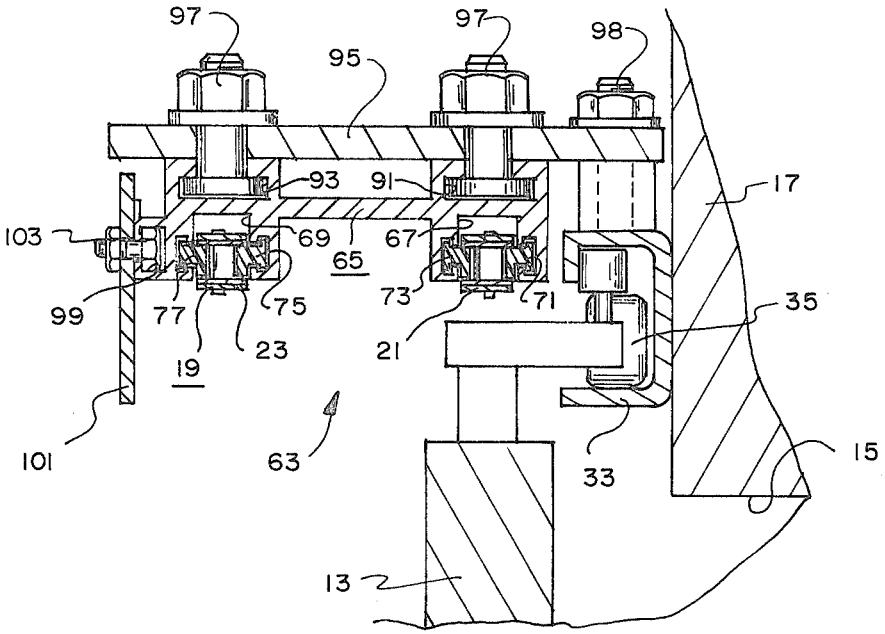
FIG. 2 is an enlarged sectional view substantially as taken on line II—II of FIG. 1.

The body means 65 preferably has a pair of upwardly directed undercut kerfs 91, 93 for selectively allowing the body means 65 to be attached to a horizontal overhead anchor surface such as the plate 95 shown in FIG. 2 by bolts 97 or the like. The plate 95 may be fixedly anchored relative to the wall 17 in any typical manner such as by being fixed to the track 33 by bolts 98. The body means 65 also preferably has a sidewardly directed undercut kerf 99 for selectively allowing a vertical member such as the shield plate 101 to be attached to the body means 65 by way of bolts 103 or the like (see FIG. 2).

The chain member 19 and the body means 65 are preferably constructed substantially of metal. The first and second guide means (i.e., the guide members 71, 73, 75, 77) are preferably constructed of a plastic material to prevent any metal-to-metal contact between the body means 65 and the chain member 19. Preferably, the body means 65 is extruded of or otherwise constructed of aluminum and the first and second guide means (i.e., the guide members 71, 73, 75, 77) are preferably extruded or otherwise constructed of nylon.

As thus constructed and used, the present invention provides a sliding door assembly in which the chain member 19 is retained so as not to "flop", which is quiet in operation with no metal-to-metal contact, has a long operating life, is safe to operate, is relatively compact and easy to install, and has a pleasant appearance.

Although the present invention has been directed and illustrated with respect to a preferred embodiment thereof and a preferred use therefore, it is not to be so limited since changes and modifications can be made therein which are within the full intended scope of the invention.

I claim:

1. In a door assembly of the type including a door member for selectively covering an opening in a wall, an endless chain member having first and second span portions joined by first and second bight portions, coupling means for coupling said chain member to said door member, and drive means for driving said chain member to cause said door member to move between an open and a closed position, the combination of a guide means for guidingly constraining said chain member, said guide means comprising:

(a) elongated body means for receiving said first and second span portions of said chain member, said body means having an elongated first channel for receiving said first span portion of said chain member and having an elongated second channel for receiving said second span portion of said chain member;

(b) elongated first guide means for guiding said first span portion of said chain member within said first channel of said body means, said first guide means including an elongated first guide member positioned within said first channel of said body means for guidingly engaging a first side of said first span portion of said chain member, said first guide means including an elongated second guide member positioned within said first channel of said body means for guidingly engaging a second side of said first span portion of said chain member; and (c) elongated second guide means for guiding said second span portion of said chain member within said second channel of said body means, said second guide means including an elongated first guide member positioned within said second channel of said body means for guidingly engaging a first side of said second span portion of said chain member, said second guide means including an elongated second guide member positioned within said second channel of said body means for guidingly engaging a second side of said second span portion of said chain member.

2. The door assembly of claim 1 in which said first and second guide means prevents any direct contact between said chain member and said body means.

3. The door assembly of claim 2 in which said body means and said chain member are constructed substantially of metal, and in which said first and second guide means are constructed of a plastic material to prevent any metal-to-metal contact between said body means and said chain member.

4. The door assembly of claim 3 in which said first channel of said body means has a first undercut kerf for fixedly receiving said first guide member of said first guide means and has a second undercut kerf for fixedly receiving said second guide member of said first guide means; and in which said second channel of said body means has a first undercut kerf for fixedly receiving said first guide member of said second guide means and has a second undercut kerf for fixedly receiving said second guide member of said second guide means.

5. The door assembly of claim 4 in which each of said guide members of said first and second guide means has an attachment flange portion for tightly fitting into said undercut kerf of the respective one of said channels of said body means.

6. The door assembly of claim 5 in which said chain member includes a plurality of spaced-apart upper and lower plate members joined by a plurality of pin members; and in which each of said guide members of said first and second guide means has a guide flange portion for extending between said upper and lower plate members of said chain member.

7. The door assembly of claim 6 in which said body means is constructed of aluminum and said guide means is constructed of nylon.

8. The door assembly of claim 7 in which said body means has a pair of upwardly directed undercut kerfs for selectively allowing said body means to be attached to a horizontal overhead anchor surface and has a sidewardly directed undercut kerf for selectively allowing vertical members to be attached to said body means.

* * * * *